US008640512B2

(12) United States Patent
Wu

(10) Patent No.: US 8,640,512 B2
(45) Date of Patent: Feb. 4, 2014

(54) LOCK STRUCTURE FOR ELECTRONIC DEVICE

(75) Inventor: Chun-Sheng Wu, New Taipei (TW)

(73) Assignee: Sinox Co., Ltd., New Taipei (TW)

( * ) Notice: Subject to any disclaimer, the term of this patent is extended or adjusted under 35 U.S.C. 154(b) by 0 days.

(21) Appl. No.: 13/478,073

(22) Filed: May 22, 2012

(65) Prior Publication Data

US 2013/0033817 A1 Feb. 7, 2013

(30) Foreign Application Priority Data

Aug. 5, 2011 (TW) ..... 100214538 U

(51) Int. Cl.
*E05B 69/00* (2006.01)

(52) U.S. Cl.
USPC ..... 70/58; 70/14; 70/30; 70/49

(58) Field of Classification Search
USPC ..... 70/14, 18, 19, 30, 49, 57, 58
See application file for complete search history.

(56) References Cited

U.S. PATENT DOCUMENTS 5,870,281 A * 2/1999 Kim ..... 361/679.57
5,913,907 A * 6/1999 Lee ..... 70/58
6,257,029 B1 * 7/2001 Liao ..... 70/58
6,779,370 B2 * 8/2004 Bellow et al. ..... 70/14
6,918,272 B1 * 7/2005 Sanders ..... 70/58
6,968,716 B1 * 11/2005 Ling ..... 70/14
6,971,254 B2 * 12/2005 Bellow et al. ..... 70/14
7,073,358 B1 * 7/2006 Lee ..... 70/58
7,076,977 B2 * 7/2006 Lee ..... 70/58
7,409,842 B2 * 8/2008 Kuo ..... 70/58
2003/0159476 A1 * 8/2003 Bellow et al. ..... 70/58
2005/0262904 A1 * 12/2005 Ling et al. ..... 70/49
2006/0112740 A1 * 6/2006 Merrem et al. ..... 70/58
2006/0288745 A1 * 12/2006 Murray et al. ..... 70/58
2011/0013361 A1 * 1/2011 White et al. ..... 361/679.55
2011/0146358 A1 * 6/2011 Avganim ..... 70/58
2012/0216581 A1 * 8/2012 Tsai ..... 70/58
2012/0227448 A1 * 9/2012 Su ..... 70/58

* cited by examiner

*Primary Examiner* — Suzanne Barrett
(74) *Attorney, Agent, or Firm* — Cheng-Ju Chiang

(57) ABSTRACT

A lock structure for an electrical device includes a rotatable fastener and a lock body. The rotatable fastener has an extending portion and a retaining portion, wherein the extending portion and the retaining portion form a T-shaped structure; the lock body is connected to the rotatable fastener and has a key hole. The lock body further has a first position and a second position in a radial direction of the extending portion. The key inserted in the key hole operates the lock body to displace from the second position to the first position, wherein the lock body drives the rotatable fastener to rotate to an unlocked position. When the lock body is in the first position, the lock body is pressed to displace from the first position to the second position, wherein the lock body drives the rotatable fastener to rotate to a locked position.

14 Claims, 9 Drawing Sheets

LOCK STRUCTURE FOR ELECTRONIC DEVICE

BACKGROUND OF THE INVENTION

1. Field of the Invention

The present invention generally relates to a lock structure. Particularly, the present invention relates to a lock structure for securing an electronic device.

2. Description of the Prior Art

Consumer electronic products have played an important role in modern life; moreover, because of fast modern lifestyle and the demand for instant information, portable electronic products have become one of the essentials for people. However, because of higher unit price and easy realizable characteristics, the possibility of portable electronic products being stolen accordingly increases.

To prevent from thieves, a lock structure had been developed, such as the notebook lock, which can connect an opening or a lock hole of electronic products through its lock fastener, wherein the surroundings of the opening or the lock hole are usually equipped with or include strengthen structures. The lock fastener is further controlled by a lock mechanism to accomplish the locking/unlocking operation. However, when using the lock mentioned above to secure an electronic product, it is required to simultaneously but individually operate the rotatable fastener and the lock body or to insert the key into the key hole to operate the lock fastener after connecting the lock to the electronic product by inserting the lock fastener into the lock hole, which is an inconvenient operation procedure. Therefore, the lock for electronic product can be improvable in operation or design.

SUMMARY OF THE INVENTION

It is an object of the present invention to provide a lock structure having an improved rotatable fastener to provide a burglarproof function for expensive items such as electronic devices.

It is another object of the present invention to provide a lock structure, which is easy to operate and is able to connect to/detach from an electronic device quickly.

The present invention provides a lock structure for an electronic device having a lock hole. In the embodiment of the present invention, the lock structure is a key lock and comprises a housing, a lock body, and a rotatable fastener. The housing includes an entering/protruding portion including two columnar structures spaced apart from each other. A through hole communicating with the cavity enclosed by the housing is located between the two columnar structures of the entering portion. Between the two columnar structures is a rotatable fastener, which has a driven portion, an extension portion, and a retaining portion, wherein the extension portion passes through the through hole and extends between and along the two columnar structures of the entering portion while having one end connecting to the driven portion in the cavity. The other end of the extension portion has the retaining portion formed thereon, wherein the retaining portion forms a T-shaped structure with the extension portion. The rotatable fastener has an axis of rotation passing therein; the rotatable fastener can rotate relative to the entering portion so that the T-shaped structure and the entering portion (namely a connecting part) can selectively engage with the lock hole and secure the electronic device to a stationary object.

In addition, the housing has a first opening, which allows a key hole of the lock body to be exposed for an unlocking operation with the cooperation of a key. Furthermore, a portion of the lock body, on which the key hole is disposed, can be selectively outside the housing for a locking operation. An elastic element is disposed on one end of the lock body. When operating the unlocking operation, the elastic element provides elasticity to push the lock body to displace by a second displacement toward the first opening and to drive the rotatable fastener to rotate to an unlocked position at which the retaining portion is parallel to the entering portion (namely parallel to a virtual connecting line Lv of the two columnar structures). At the unlocked position, the retaining portion is within a projection area of the entering portion, the connecting part (namely the extension portion, the retaining portion, and the entering portion) of the lock structure is therefore able to be inserted into the lock hole of the electronic device or be detached therefrom. On the other hand, when operating the locking operation by pressing the lock body in a direction perpendicular to the axis of rotation of the rotatable fastener, namely in a radial direction of the extension portion, the lock body will displace by a first displacement away from the first opening and drive the rotatable fastener to rotate to a locked position at which the retaining portion is perpendicular to the entering portion (namely perpendicular to a virtual connecting line Lv of the two columnar structures). At the locked position, the retaining portion protrudes out the projection area of the entering portion. The first displacement mentioned above is the same with the direction of pressing the lock body while the second displacement is the reverse of that of pressing the lock body. In other words, the lock body displaces back and forth in the radial direction of the extension portion.

A gear rack-like driving portion is disposed on the lock body, while the driven portion of the rotatable fastener has a gear wheel-like structure. The driving portion and the driven portion are in contact with each other. Specifically, a groove of the gear rack-like driving portion matches up and engages with a tooth of the gear wheel-like driven portion; and vice versa. When the lock body displaces by the first or the second displacement, the driving portion also moves in relative to the driven portion in the direction the same with the direction of the first or the second displacement, wherein the driving portion drives the driven portion and the rotatable fastener to rotate by means of matching up and engagement of the gear wheel-like and gear rack-like structures. When the lock body displaces by the first displacement, the engagement of the gear rack-like driving portion and the gear wheel-like driven portion makes the displacement of the driving portion drive the rotatable fastener to the locked position at which the retaining portion is perpendicular to the entering portion; meanwhile, if the connecting part of the lock structure for connecting to the lock hole has been inserted into the lock hole, the rotatable fastener also rotates relative to the lock hole (namely the axis of rotation C is perpendicular to the plane where the lock hole H lies) and enables the connecting part be engaged with the lock hole. When the lock body displaces by the second displacement, the engagement of the gear rack-like driving portion and the gear wheel-like driven portion make the displacement of the driving portion drive the rotatable fastener to the unlocked position at which the retaining portion is parallel to the entering portion; meanwhile, if the connecting part of the lock structure for connecting to the lock hole has been inserted into the lock hole, the rotatable fastener also rotates relative to the lock hole and then allows the connecting part to detach from the lock hole.

DETAILED DESCRIPTION OF THE PREFERRED EMBODIMENT

Figure 1A:
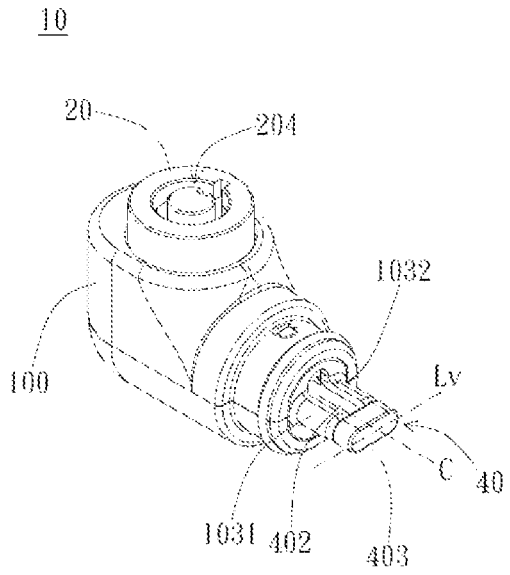
FIGS. 1A-1C show perspective views of the embodiment of the present invention.
Figure 1B:
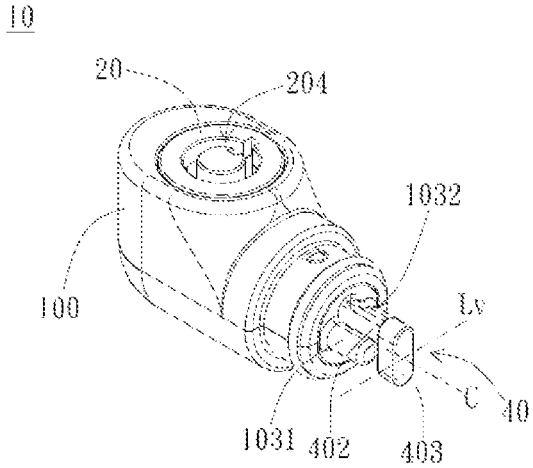
Figure 1C:
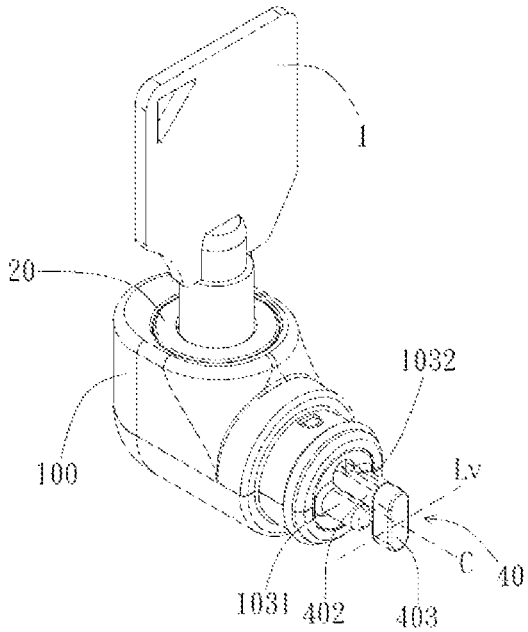

The present invention provides a lock structure for electronic devices, such as but is not limited to laptops or notebooks. As FIGS. 1A-1C show, the lock structure 10 is a key lock 10, including a housing 100, a lock body 20, and a rotatable fastener 40, wherein a key hole 204 is formed on the lock body 20 to accept a key having adequate or specific structure inserted therein to operate an unlocking operation of the lock body 20. On the other hand, the housing 100 encloses at least a cavity or has an interior for accommodating at least a portion of the lock body 20 and at least a portion of the rotatable fastener 40, wherein the lock body 20 and the rotatable fastener 40 are moveable in the cavity or interior. The lock structure 10 can further have a flexible cable (not shown), wherein the flexible cable together with the lock structure 10 can secure the electronic device to a stationary object, such as a table. An entering portion 1031 is disposed on one side of the housing 100 and protrudes outwards, wherein the entering portion 1031 includes two columnar structures spaced apart from each other. The two columnar structures can be, for example, two opposite semi-circular columns separated from a circular column and are configured to restrict one-dimensional movement. A through hole 1032 communicating with the cavity or interior of the housing 100 is located between the two columnar structures of the entering portion 1031. The rotatable fastener 40 has an extension portion 402 passing through the through hole 1032 and extending between and along the two columnar structures of the entering portion 1031, wherein the extension portion 402 preferably has a circular column-like structure and has a circular vertical cross-section. In addition, the rotatable fastener 40 has a retaining portion 403 formed on one end of the extension portion 402 and protruding out of the entering portion 1031, wherein the retaining portion 403 can form a T-shaped structure with the extension portion 402. The rotatable fastener 40 has an axis of rotation C passing therein and can rotate (namely revolves on its own axis C), wherein the axis C is perpendicular to a radial direction of the extension portion 402; in other words, the radial direction is any direction parallel to a plane where the vertical cross-section of the extension portion 402 lies. The revolving of the rotatable fastener 40 on its own axis C further allows the T-shaped structure and the entering portion 1031 to selectively engage with the lock hole of the electronic device so that the lock structure 10 secures the electronic device to an stationary object. The relations in structure and movement among the housing 100, the lock body 20, and the rotatable fastener 40 will be described later.

Figure 2:
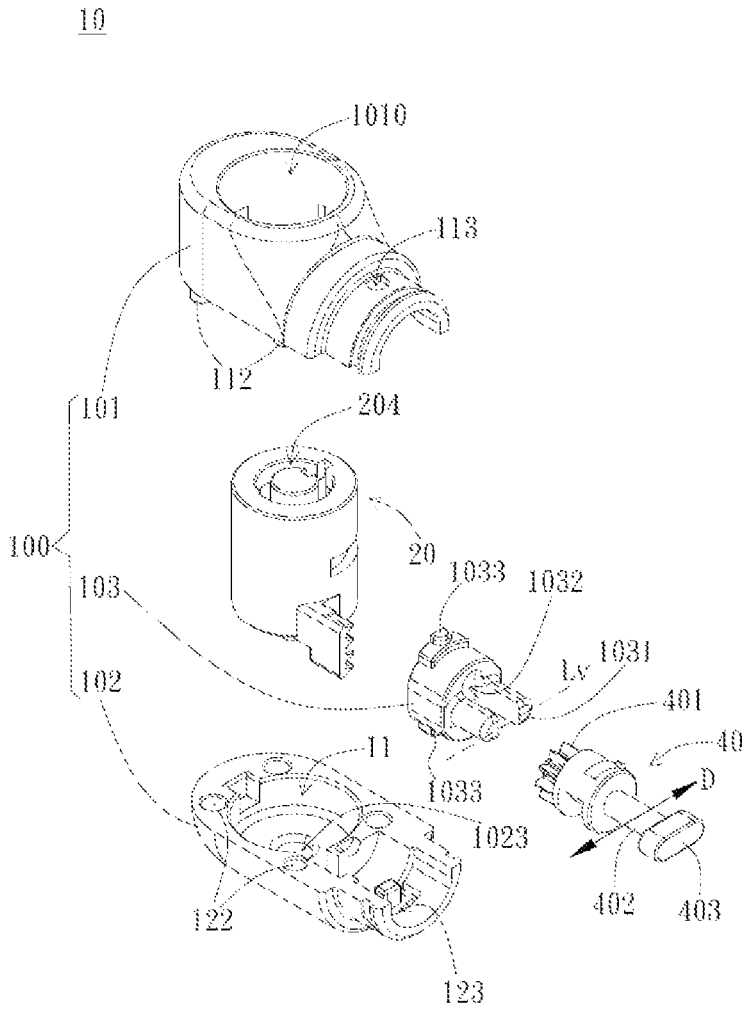
FIG. 2 is an exploded view of the embodiment shown in FIGS. 1A and 1B.

An exploded view of the embodiments shown in FIGS. 1A and 1B is shown in FIG. 2. The housing 100 is preferably composed of several housing parts. For example, the housing 100 includes a first housing part 101, a second housing part 102, and a connecting unit 103 connected to each other to form a cavity 11 for accommodating other components of the lock structure 10, wherein the connection can be accomplished by any prior arts such as ways of engagement, adhering, or fastening. In one preferred embodiment, the first housing part 101 has a plurality of coupling posts 112, and the second housing part 102 has a plurality of holes 122 corresponding to the plurality of coupling posts 112 of the first housing part 101. In addition, the first housing part 101 and the second housing part 102 further respectively have at least one hole, such as a hole 113 and a hole 123. The connecting unit 103 has a plurality of coupling posts 1033 corresponding to the hole 113 and the hole 123. The holes 122 and the coupling posts 112 mentioned above can align and then engage with each other so that the first housing part 101, the second housing part 102, and the connecting unit 103 are combined to form the housing 100 to accommodate the lock body 20. In addition, the first housing part 101 has a first opening 1010, which allows the key hole 204 of the lock body 20 to be exposed and an unlocking operation to be performed with the cooperation of a key. Furthermore, part of the lock body 20, where the key hole 204 is disposed, can selectively protrude outside the housing 100 from the first opening 1010 for a locking operation. An elastic element 25 (shown in FIGS. 3B and 4B) is disposed on one end of the lock body 20 facing the second housing part 102 (namely the end of the lock body 20 opposite to the key hole 204). The elastic element 25 can be disposed in, for example, an accommodating trough 1023 formed on a wall of the cavity 11 (namely an inner wall of the housing 100) and contacts with the inner wall to selectively provide elasticity due to compression.

The first housing part 101 and the second housing part 102 together connect the connecting unit 103. One side of the connecting unit 103 is formed with the entering portion 1031 as mentioned above; the through hole 1032 communicating with the cavity/interior of the housing 100 is located between the two columnar structures of the entering portion 1031. In one embodiment of the present invention, the connecting unit 103 is fitted to the rotatable fastener 40 so that the extension portion 402 and the retaining portion 403 pass through the through hole 1032, wherein the extension portion 402 is substantially parallel to the entering portion 1031 of the connecting unit 103; the retaining portion 403 protrudes out of the ends of the columnar structures of the entering portion 1031. The rotatable fastener 40 can rotate relative to the entering portion 1031; meanwhile, an extension direction of the retaining portion 403, which is substantially perpendicular to the direction of the extension portion 402, changes accordingly so that being selectively parallel or perpendicular to a virtual connecting line Lv of the two columnar structures in order to enable the lock hole-connecting part (namely the extension portion 402, the retaining portion 403 and the entering portion 1031) of the lock structure 10 to detach from the lock hole or engage with the lock hole. (Comparing FIGS. 1A and 1B. In FIG. 1A, the extension direction of the retaining portion 403 is parallel to the virtual connecting line Lv; in FIG. 1B, the extension direction of the retaining portion 403 is perpendicular to the virtual connecting line Lv.). A radial direction D of the extension portion 402 is illustrated in FIG. 2 (namely D is one of the radial directions of the extension portion 402).

The rotatable fastener 40 further includes a driven portion 401. In comparison to the extension portion 402 and the retaining portion 403, the driven portion 401 is located in the cavity 11 and adjoins the lock body 20. As mentioned above, the lock body 20 has a key hole 204 formed thereon to accept a key having an adequate or specific structure inserted therein, in cooperation with the lock core (not shown), to operate the unlocking operation of the lock body 20 in a locked status. The structure and operation of the lock body 20 are similar to the conventional key lock and are well-known to a skilled person in the art. Accordingly, the detailed description is omitted.

Figure 3A:
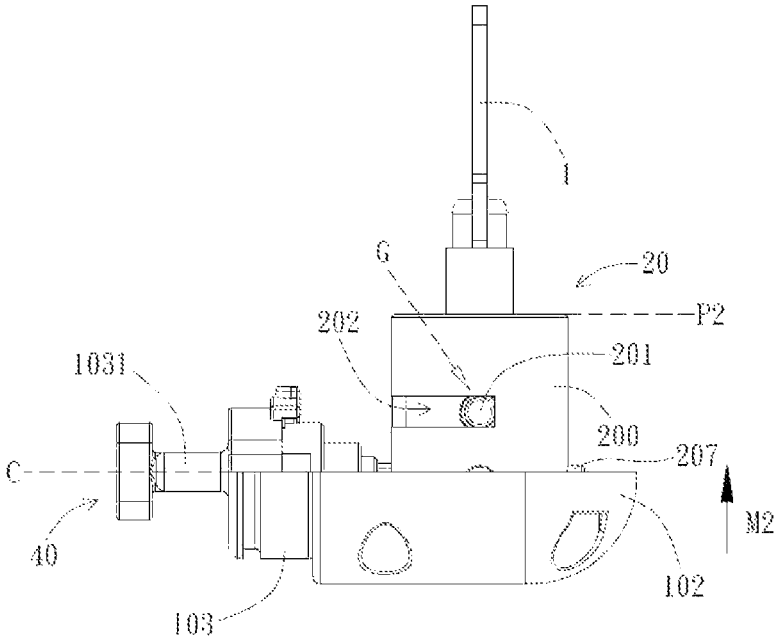
FIGS. 3A-3B are side views of the embodiment shown in FIG. 1C having a portion of the housing removed.
Figure 3B:
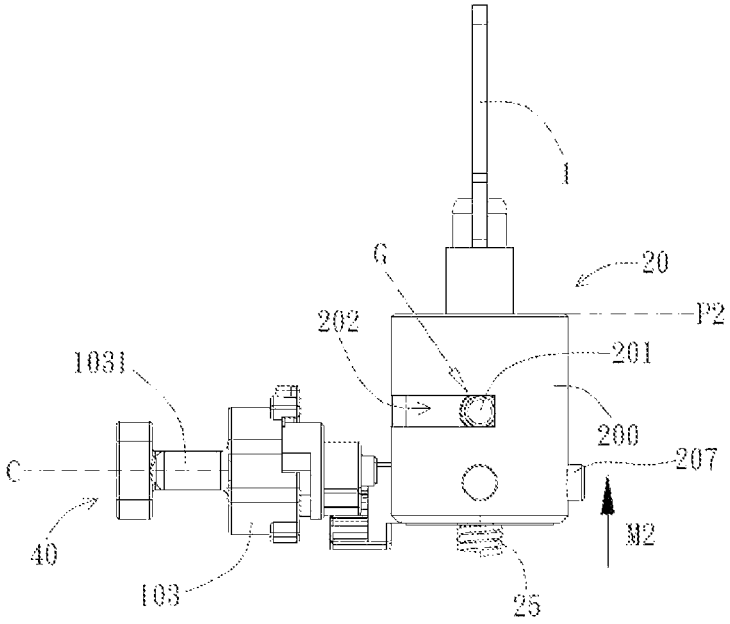
Figure 3C:
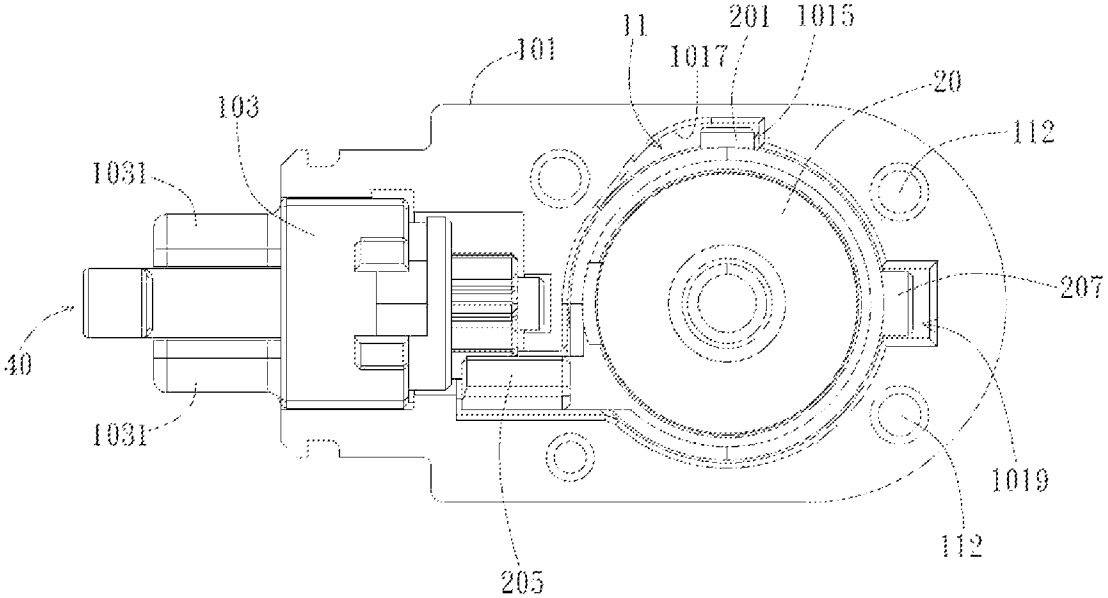
FIG. 3C is a bottom view of the embodiment shown in FIG. 1C having a portion of the housing removed.
Figure 4A:
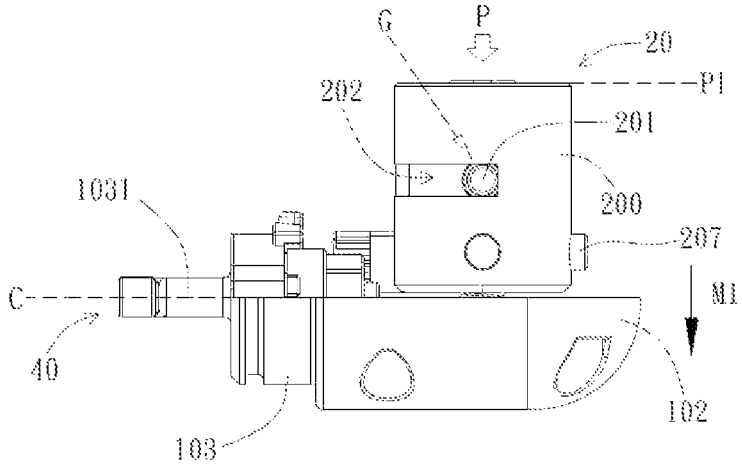
FIGS. 4A-4B are side views of the embodiment shown in FIG. 1A having a portion of the housing removed.
Figure 4B:
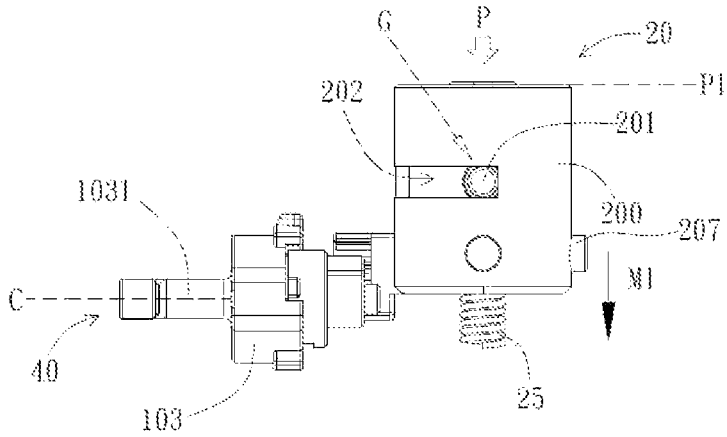

In the preferred embodiment of the present invention, the lock body 20 in the locked status is shown in FIGS. 3A-3C, wherein the lock body 20 has a lock body housing 200, a movable pin 201, and a guiding channel 202 formed on the lock body housing 200. In the locked status, the movable pin 201 of the lock body 20 protrudes out of the guiding channel 202 and is secured in a corresponding positioning trough 1015 formed on the wall of the cavity 11. When operating the unlocking operation, the movable pin 201 in a position G of the guiding channel 202 rotates along with the lock core (not shown) and moves along the guiding channel 202 and an inclined plane 1017 of the positioning trough 1015 so that the movable pin 201 is released from being secured in the positioning trough due to the inclined plane; in other words, the wall of the cavity 11 releases the restriction to the lock body 20. Thereafter, the lock body 20 is pushed to move toward the first opening 1010 (please refer to FIG. 2) and away from the second housing part 102 by a second displacement M2 as a result of the elasticity of the elastic element 25. Then the lock body 20 finally reaches an unlocked status as shown in FIGS. 4A-4B; meanwhile, the lock core (not shown) rotates back so that the movable pin 201 accordingly moves along the guiding channel 202, and then reaches the position G. At this time, however, the movable pin 201 is not secured in any trough; the lock body 20 is not restricted, either. Furthermore, a positioning pin 207 disposed on the lock body 20, and a trough 1019 for accommodating the positioning pin 207 is formed on the wall of the cavity (namely the inner wall of the first housing part 101). When the lock body 20 displaces by the second displacement M2 due to the elasticity of the elastic element 25, the positioning pin 207 displaces along the trough. In addition, the trough 1019 has at least a closed end, the trough 1019 can determine a distance of the second displacement M2 by limiting the movement of the positioning pin 207 therein. On the other hand, the lock body 20 displacing by the second displacement M2 also drives the rotatable fastener 40 to rotate to an unlocked position, enabling the retaining portion 403 to be parallel to the entering portion 1031 (namely parallel to the virtual connecting line Lv of the two columnar structures). At the unlocked position, the retaining portion 403 is within a projection area of the entering portion 1031, the connecting part (namely the extension portion 402, the retaining portion 403, and the entering portion 1031) of the lock structure 10 is therefore able to be inserted into the lock hole of the electronic device or detach therefrom. In addition, the location of the closed end of the troughs 1015 or 1019 mentioned above is preferably designed in a manner that after rotation, the rotatable fastener 40 can reach the above mentioned status, namely the retaining portion 403 is substantially parallel to the entering portion 1031.

On the other hand, the locking operation in the present invention is achieved by operating the lock body 20 to displace from the first position P1 to the second position P2 in the radial direction of the extension portion 402; in other words, the lock body 20 at the second position P2 is in a locked status. Furthermore, in the preferred embodiment of the present invention, as FIGS. 3A and 4A show, the lock body 20 displacing from the first position P1 to the second position P2 is achieved by pressing the portion of the lock body 20 exposed outside the housing 100, wherein pressing the lock body 20 makes the lock body 20 move toward the second housing part 102 by a first displacement Ml; meanwhile, the lock body 20 compresses the elastic element 25 and makes the elastic element 25 store up elasticity as mentioned above for the unlocking operation. After the lock body 20 displacing by the first displacement Ml, the guiding channel 202 thereon moves back to the position corresponding to the positioning trough so that the lock body 20 is confined by the wall of the cavity 11 again and is unable to displace in the direction of the first displacement Ml. In addition, the lock body 20 cannot displace by the second displacement M2 without operation of the key 1 having an adequate structure, either. On the other hand, the lock body 20 displacing by the first displacement Ml also drives the rotatable fastener 40 to rotate to the locked position so that the retaining portion 403 is perpendicular to the entering portion 1031 (namely perpendicular to the virtual connecting line Lv of the two columnar structures). At the locked position, the retaining portion 403 protrudes out of the projection area of the entering portion 1031. In addition, the location where the guiding channel 202 corresponds to the positioning trough is preferably designed in a manner that after rotation, the rotatable fastener 40 will be at a preferred status, namely the retaining portion 403 is substantially perpendicular to the entering portion 1031.

In sum, the second/first displacement M2 and M1 caused by the unlocking/locking operation of the lock body 20 drive the fastener rotatable 40 to rotate. In addition, when operating the locking operation, a direction of pressing the lock body 20 is the radial direction of the extension portion 402, which is perpendicular to the axis C; in other words, the direction of pressing the lock body 20 is parallel to the plane where the vertical cross-section of the extension portion 402 lies. Moreover, in the preferred embodiment of the present invention, the direction of the first displacement M1 is the same with the direction P of pressing the lock body 20, namely same as the direction of the displacement from the first position P1 to the second position P2. In addition, the direction of the second displacement M2 is reverse to the direction P of pressing the lock body 20, namely same as the direction of the displacement from the second position P2 to the first position P1. In other words, it is preferred that the lock body 20 displaces back and forth between the first position P1 and the second position P2, wherein the lock body 20 at the second position P2 is in the locked status; the lock body 20 at the first position P1 is in the unlocked status. In other embodiments of the present invention, the pressing in the radial direction of the extension portion 402 may result in the lock body 20 displacing in a direction different to the pressing direction. For example, the pressing in the radial direction of the extension portion 402 could result in the lock body displacing in such as the axial direction of the extension portion 402, which consequently enable the driving portion to drive the rotatable fastener to rotate.

Figure 5:
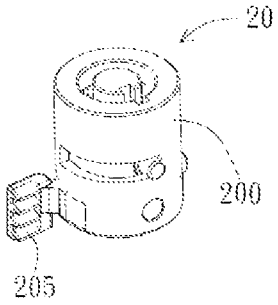
FIG. 5 is a perspective view of the embodiment of the lock body of the present invention.
Figure 6A:
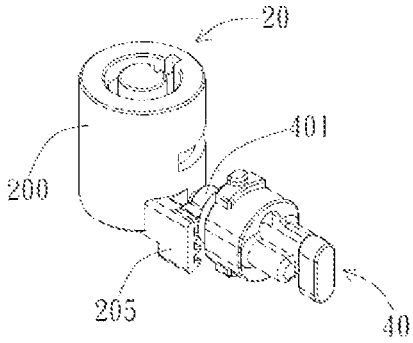
FIGS. 6A-6B are perspective views of the embodiment of the present invention having a portion of the housing removed.
Figure 6B:
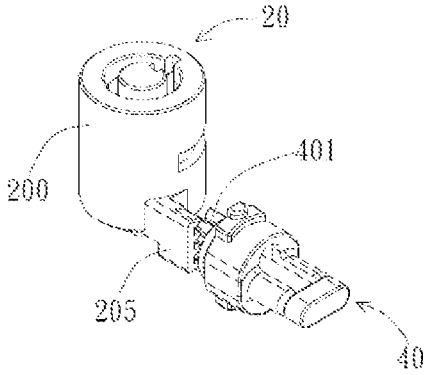

The lock body 20 includes a driving portion 205, wherein the driving portion 200 is preferably an extension of the lock body housing 200. In other embodiments, however, the driving portion 205 may be additionally disposed on the lock body or the lock body housing. The driving portion 205 contacts the driven portion 401 of the rotatable fastener 40. In the preferred embodiment of the present invention, the structure of the driven portion 401 is formed as at least part of a gear wheel; the structure of the driving portion 205 is formed as a gear rack to match up and engage with the gear wheel-like structure, as FIG. 5 shows. Specifically, a groove of the gear rack-like driving portion 205 matches up a tooth of the gear wheel-like driven portion 401, as FIGS. 6A-6B show, and vice versa. When the lock body 20 displaces by the first displacement M1 or the second displacement M2 as mentioned above, the driving portion 205 also moves relative to the driven portion 401 in the direction the same with the direction of the first displacement M1 or the second displacement M2 so that the driving portion 205 is able to drive the rotation of the driven portion 401 and therefore the rotatable fastener 40 due to the engagement of the gear wheel-like and gear rack-like structures. In other words, the back and forth displacement of the lock body 20 between the first position P1 and the second position P2 in the radial direction of the extension portion 402 makes the driving portion 205 to drive the driven portion 401 and the rotatable fastener 40 to rotate. The number of teeth of the gear wheel-like driven portion 401 is preferably large enough to engage with the grooves of the gear rack-like driving portion 205 and to make the rotatable fastener 40 rotate to achieve the positions mentioned above. However, cooperation of the driving portion and the driven portion is not limited to be accomplished by the combination of the gear wheel-like and the gear rack-like structures; the way that the lock body 20 makes the driving portion move is not limited to displacing the driving portion and the lock body in the same direction simultaneously. Any mechanism and operation in which displacement of the lock body 20 in the radial direction of the extension portion 402 makes the driving portion drive the driven portion and the rotatable fastener to rotate is in the scope of the present invention.

Figure 7A:
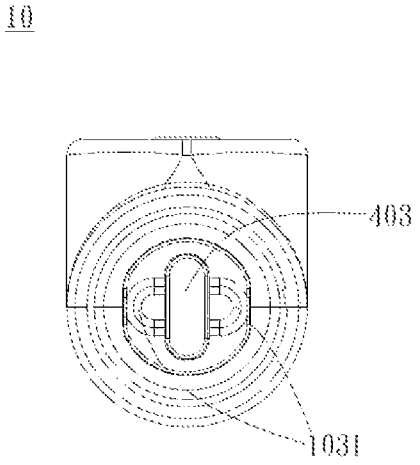
FIG. 7A is a front view of the embodiment shown in FIG. 1B.

As FIGS. 3A-4B show, when operating the locking operation with regard to the lock structure 10 shown in FIG. lA by means of pressing the lock body 20, the lock body 20 will displace by the first displacement Ml and make the gear rack-like driving portion 205 move relative to the driven portion 401. At the same time, moving of the driving portion 205 relative to the driven portion 401 drives the rotatable fastener 40 to rotate to the position at which the extension direction of the retaining portion 403 is perpendicular to the entering portion 1031 (namely perpendicular to the virtual connecting line Lv of the two columnar structures); at the position, the retaining portion 403 protrudes out the projection area of the entering portion 1031. From FIG. 7A, it can be seen a cross-like configuration formed by the end of the entering portion 1031 and the retaining portion 403; meanwhile, the lock body 20 is in the locked status and is not pressing-operable (namely operating the locking operation), as shown in FIG. lB. Furthermore, as FIG. 8A shows, if the connecting part of the lock structure 10 (namely the entering portion 1031, the extension portion 402, and the retaining portion 403) for connecting to the lock hole H has been inserted into the lock hole H, the locking operation mentioned above will drive the rotatable fastener 40 at the unlocked position to rotate relative to the lock hole H (namely the axis of rotation C is perpendicular to the plane where the lock hole H lies) so that the connecting part is engaged with the lock hole H.

Figure 7B:
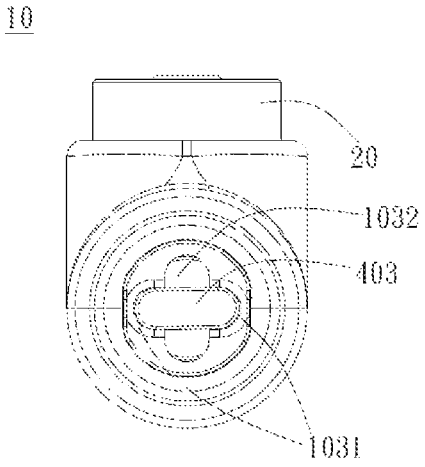
FIG. 7B is a front view of the embodiment shown in FIG. 1A.

As FIGS. 3A-4B show, when operating the unlocking operation with regard to the lock structure 10 shown in FIG. lB by means of the key 1 (shown in FIG. 1C), the lock body 20 will displace by the second displacement M2 and make the gear rack-like driving portion 205 move relative to the driven portion 401. At the same time, moving of the driving portion 205 relative to the driven portion 401 drives the rotatable fastener 40 to rotate to the position at which the extension direction of the retaining portion 403 is parallel to the entering portion 1031 (namely parallel to the virtual connecting line Lv of the two columnar structures); at the position, the retaining portion 403 is within the projection area of the entering portion 1031. From FIG. 7B, it can be seen a straight line-like configuration made by the end of the entering portion 1031 and the retaining portion 403; meanwhile, the lock body 20 is in the unlocked status and is pressing-operable (namely operating the locking operation), as shown in FIG. 1A. Furthermore, as FIG. 8B shows, if the connecting part of the lock structure 10 (namely the entering portion 1031, the extension portion 402, and the retaining portion 403) to connect to the lock hole H has been inserted into the lock hole H, the unlocking operation mentioned above will drive the rotatable fastener 40 to rotate relative to the lock hole H (namely the axis of rotation C is perpendicular to the plane where the lock hole H lies) to reach the unlocked position. Rotation of the rotatable fastener 40 enables the connecting part (including the retaining portion 403, the extension portion 402, and the entering portion 1031), which is for connecting the lock hole H of the electronic device, to be able to detach from the lock hole H of the electronic device. On the other hand, if the connecting part of the lock structure 10 has not been inserted into the lock hole H when operating the unlocking operation, the unlocking operation which drives the rotatable fastener 40 to rotate will also make the connecting part be able to be inserted into the lock hole H.

Figure 8A:
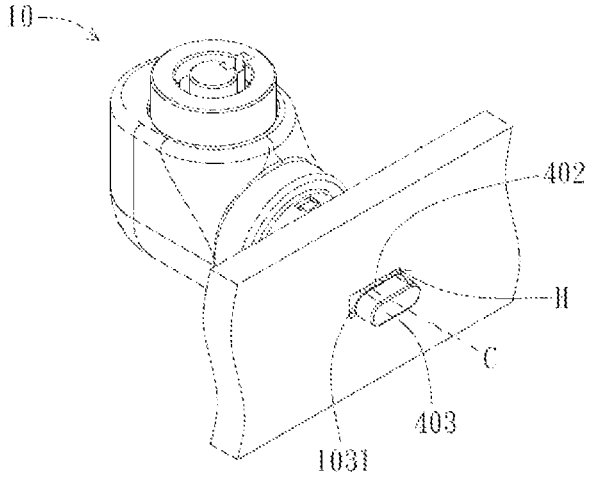
FIGS. 8A-8B are schematic views of the embodiment of the present invention and the lock hole.
Figure 8B:
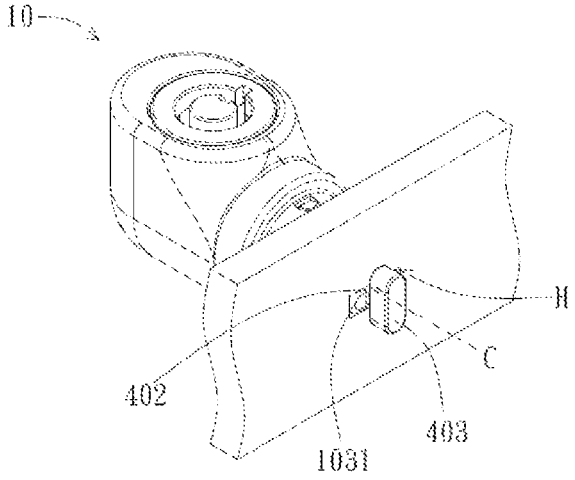

As FIGS. 8A-8B show, the rotation of the rotatable fattener 40 driven by the driving portion 205 is preferably a rotation of 90 degrees in a clockwise/counterclockwise direction so that the retaining portion 403 of the rotatable fastener 40 can be secured to the best degree when the connecting part is engaged with the lock hole H.

Although the preferred embodiments of present invention have been described herein, the above description is merely illustrative. The preferred embodiments disclosed will not limited the scope of the present invention. Further modification of the invention herein disclosed will occur to those skilled in the respective arts and all such modifications are deemed to be within the scope of the invention as defined by the appended claims.

What is claimed is:

1. A lock structure for an electronic device with a lock hole, comprising:

a rotatable fastener having a retaining portion and an extension portion, the retaining portion and the extension portion together forming a T-shaped structure; and a lock body, connected to the rotatable fastener, having a key hole for a key to be inserted thereto, the lock body being selectively at a first position or a second position in a radial direction of the extension portion, wherein the key inserted into the key hole is able to operate the lock body to displace from the second position to the first position and to drive the rotatable fastener to rotate to an unlocked position; when the lock body is at the first position, the lock body is able to be pressed to displace from the first position to the second position and to drive the rotatable fastener to rotate to a locked position.

2. The lock structure of claim 1, wherein the lock body displaces in the radial direction of the extension portion from the first position to the second position by a first displacement; the lock body displaces in the radial direction of the extension portion from the second position to the first position by a second displacement.

3. The lock structure of claim 2, wherein the direction of the second displacement and the direction of the first displacement are reverse.

4. The lock structure of claim 1, further comprising a driving portion disposed on the lock body, wherein the rotatable fastener includes a driven portion in contact with the driving portion.

5. The lock structure of claim 4, wherein the driving portion includes a gear rack, the driven portion includes at least part of a gear wheel.

6. The lock structure of claim 4, wherein the lock body displaces between the first position and the second position allowing the driving portion to drive the driven portion.

7. The lock structure of claim 6, wherein the lock body displaces between the first position and the second position driving the rotatable fastener to rotate ninety degrees.

8. The lock structure of claim 1, further including:

a housing having a cavity for accommodating the lock body and a portion of the rotatable fastener;

wherein the housing includes a connecting unit on one side of the housing, and the connecting unit has an entering portion to be inserted into the lock hole.

9. The lock structure of claim 8, wherein the connecting unit has a through hole communicating with the cavity; the extension portion and the retaining portion of the rotatable fastener pass through the through hole and protrude out of the housing to connect to the lock hole.

10. The lock structure of claim 8, wherein the rotatable fastener includes a driven portion disposed in the cavity.

11. The lock structure of claim 9, wherein the entering portion includes two separated columnar structures, the through hole is located between the two separated columnar structures.

12. The lock structure of claim 11, wherein the lock body drives the rotatable fastener to rotate relative to the entering portion.

13. The lock structure of claim 8, wherein the extension portion is substantially parallel to and extends along the entering portion; an end of the retaining portion protruding out of the end of the entering portion forms a T-shaped structure with the extension portion.

14. The lock structure of claim 8, further including an elastic element disposed on one end of the lock body opposite to the key hole, wherein the elastic element contacts a wall surrounding the cavity.

* * * * *